United States Patent [19]

Shiozaki et al.

[11] Patent Number: 4,938,616

[45] Date of Patent: Jul. 3, 1990

[54] THERMAL PRINTER

[75] Inventors: Tsugio Shiozaki, Susono; Osamu Koizumi, Shizuoka; Ikuzo Sugiura, Sagamihara, all of Japan

[73] Assignee: Tokyo Electric Co., Ltd., Tokyo, Japan

[21] Appl. No.: 256,766

[22] Filed: Oct. 11, 1988

[30] Foreign Application Priority Data

Oct. 14, 1987 [JP] Japan ..... 62-258684

[51] Int. Cl.[5] ..... B41J 3/02

[52] U.S. Cl. ..... 400/120; 346/76 PH; 219/216 PH

[58] Field of Search ..... 400/120; 346/76 PH; 219/216 PH

[56] References Cited

U.S. PATENT DOCUMENTS

| | | | |
|---|---|---|---|
| 4,169,682 | 10/1979 | Norman . | |
| 4,397,576 | 8/1983 | Drejza et al. | 400/120 |
| 4,562,444 | 12/1985 | Nagashima et al. . | |
| 4,650,351 | 3/1987 | Engle et al. . | |
| 4,654,673 | 3/1987 | Yawata et al. | 400/120 |
| 4,744,680 | 5/1988 | Hirosaki et al. | 400/120 |
| 4,818,126 | 4/1989 | Brooks et al. | 400/120 |
| 4,830,523 | 5/1989 | Sparer et al. | 400/120 |
| 4,844,632 | 7/1989 | Minowa | 400/120 |

FOREIGN PATENT DOCUMENTS 61-266271 11/1986 Japan .

*Primary Examiner*—Eugene H. Eickholt

*Attorney, Agent, or Firm*—Frishauf, Holtz, Goodman & Woodward

[57] ABSTRACT

A thermal printer comprises a pair of fixed frames for rotatably supporting a platen, a head unit movable relatively to the fixed frames and swingably supporting an elongated thermal head around its intermediate portion, a pair of leaf springs, one end of which resiliently urges the head unit toward the fixed frames so that the thermal head is pressed resiliently against the platen across a paper sheet, and a cam member having cam faces which are selectively engaged with the other end of the leaf spring for changing the urging force of the leaf spring by stages in accordance with the quality of the paper sheet.

35 Claims, 8 Drawing Sheets

THERMAL PRINTER

BACKGROUND OF THE INVENTION

1. Field of the Invention

The present invention relates to a thermal printer adapted for printing characters and bar codes on paper sheets, such as labels.

2. Description of the Related Art

As an example of the conventional thermal transfer printer of this type, there is a label printer which is disclosed in Japanese Patent Disclosure No. 61-266271 (corresponding to U.S. Pat. No. 4,744,680, issued on May 17, 1988) by the same applicant.

In this label printer, characters and bar codes are printed on a label sheet by means of a line thermal printing head with a large printing width. In printing, the printing head is pressed against a platen with a ink ribbon and the label sheet between the head and the platen. This precedent invention is characterized in that a printer unit, in which a line thermal head and ink ribbon supply and take-up spindles are mounted on a pair of frames, is rockably or movably attached to a fixed mechanism section of a casing of the printer.

According to the prior art printer described above, the line thermal printing head is mounted on a head holding plate, and is pressed against the platen by means of a compression spring which is disposed between the head holding plate and a spring retaining metal. In this arrangement, the force to press the head against the platen is uneven, thus easily entailing defective printing or irregular sheet feed.

SUMMARY OF THE INVENTION

The object of the present invention is to provide a thermal printer in which a thermal printing head can be pressed uniformly against a platen.

According to the present invention, there is provided a thermal printer which comprises: a platen; platen supporting means for supporting the platen; a thermal head; thermal head supporting means movable relatively to the platen supporting means and swingably supporting the thermal head around its intermediate portion, the thermal head supporting means being moved so as to press the thermal head against the platen; and resilient urging means for resiliently urging the thermal head supporting means toward the platen supporting means so that the thermal head is pressed resiliently against the platen.

Thus, in the thermal printer according to the present invention, the thermal head is swingably supported by head supporting means which is movable with respect to the platen supporting means. Accordingly, the force to press the thermal head against the platen is uniform throughout, so that defective printing and irregular sheet feed can be prevented.

DETAILED DESCRIPTION OF THE PREFERRED EMBODIMENTS

Figure 1A:
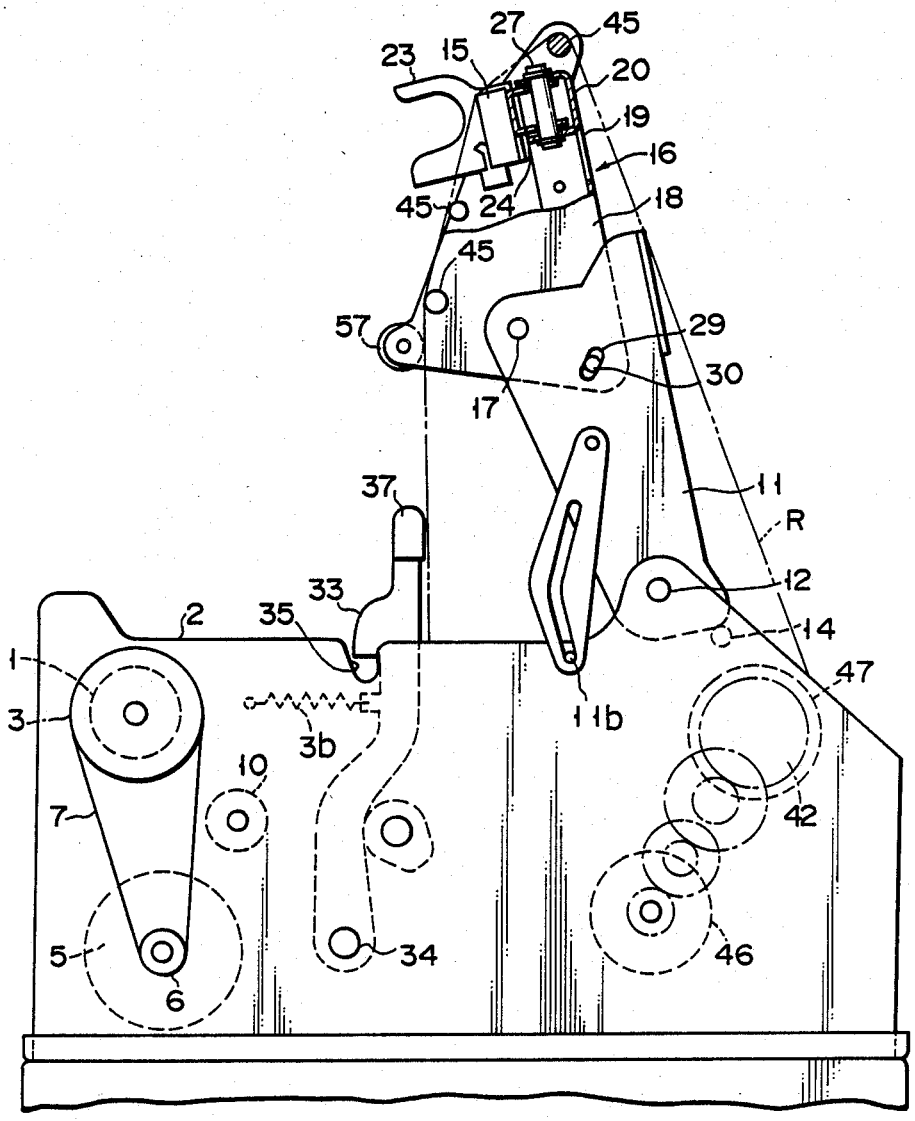
FIGS. 1A and 1B are right- and left-hand side views, respectively, of a thermal transfer printer according to an embodiment of the present invention.
Figure 1B:
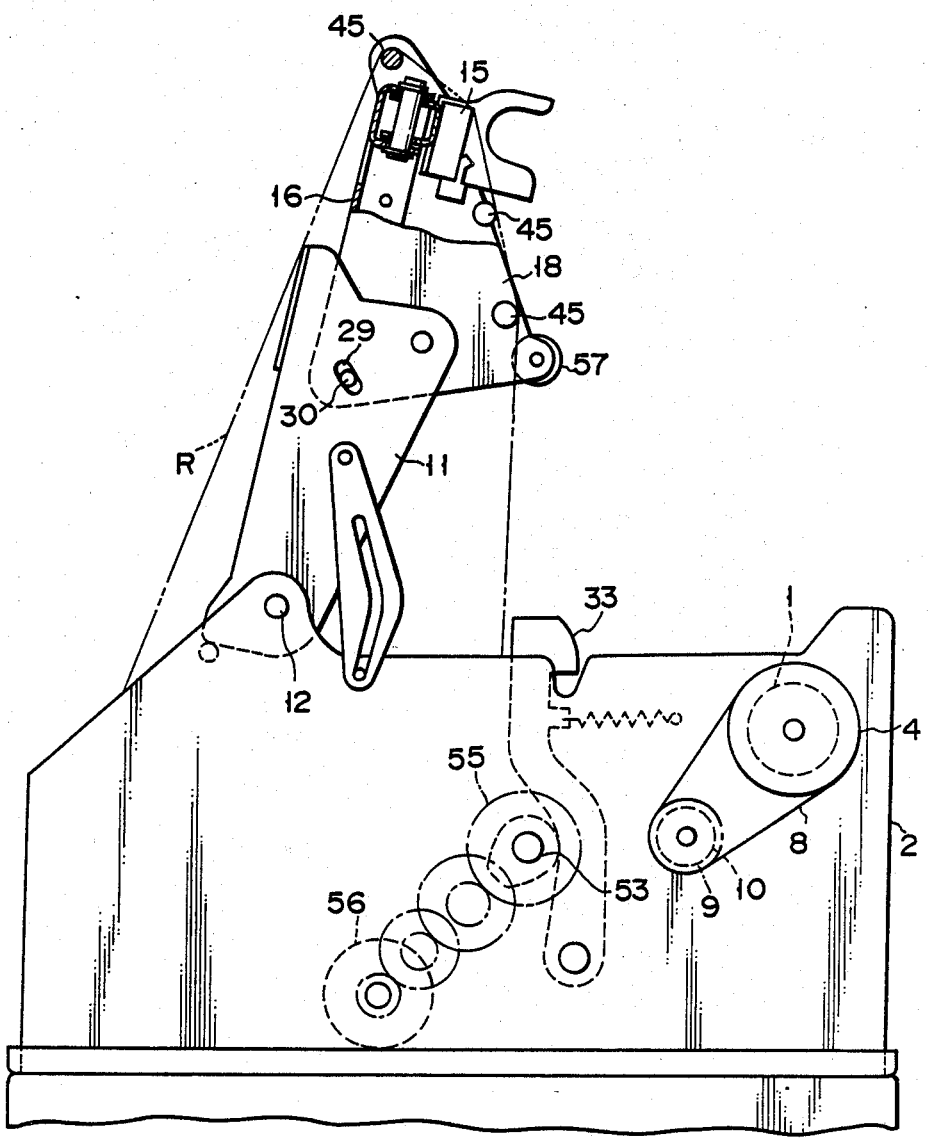

Referring now to the drawings of FIGS. 1 to 8, a thermal transfer printer according to an embodiment of the present invention will be described in detail.

In these drawings, numeral 1 designates a roller-shaped platen which is rotatably supported, at both ends thereof, on a pair of fixed frames (fixed supporting means for a platen) which are opposed to each other at a predetermined distance. Timing gears 3 and 4 are fixed individually to the respective projecting ends of slender platen shafts 21 at either end of platen 1. Timing belt 7 is passed around timing gear 3 (FIG. 1A) and motor gear 6 so that the driving force of platen drive motor 5 can be transmitted to gear 3 by means of motor gear 6 and belt 7. Motor 5 is mounted on the inside of one of fixed frames 2 with its rotating shaft projecting from the frame, for rotation in both forward and reverse directions. The other timing gear 4 is connected to timing belt 8 (FIG. 1B) so that the rotation of motor 5 can be transmitted to timing gear 9 through belt 8. Gear 9 is mounted on one end of sheet rewinding roller 10 which is rotatably supported, at both ends thereof, on fixed frames 2. Thus, roller 10 can be rotated in the same direction as platen 1.

Figure 2:
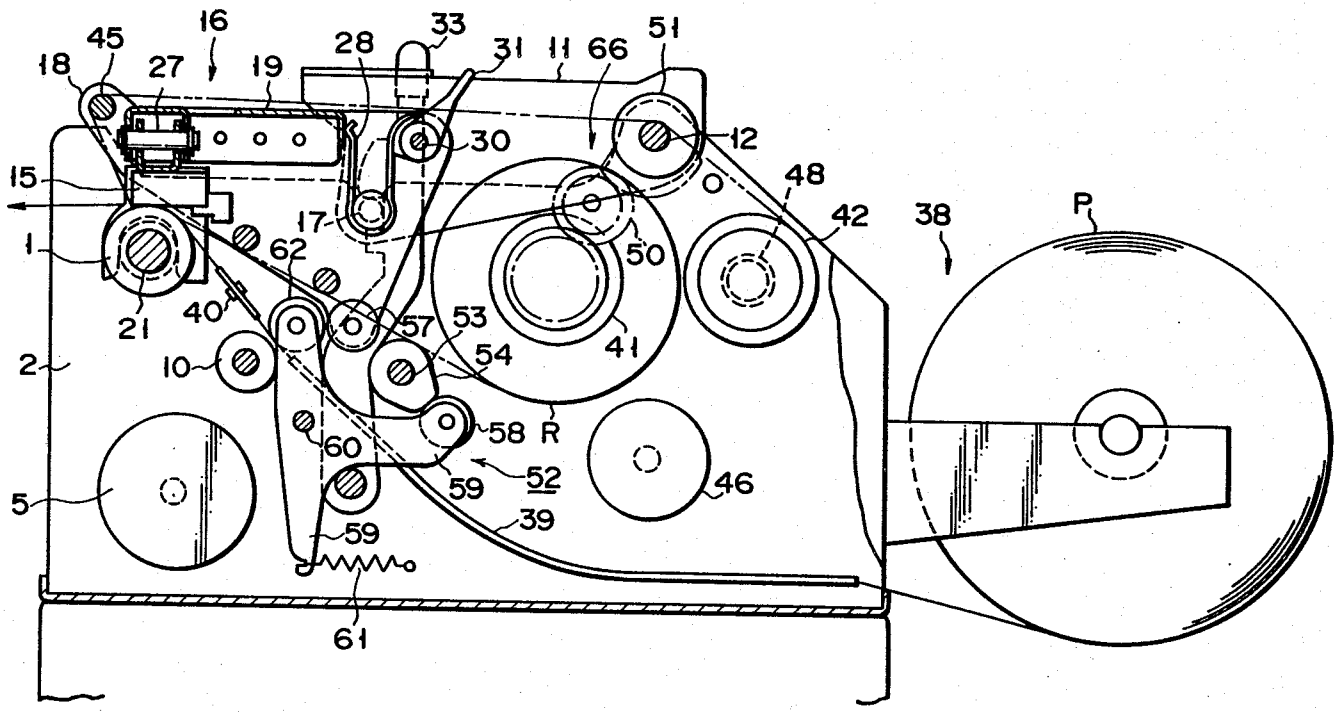
FIG. 2 is a vertical sectional view of the printer.

A pair of movable frames (movable supporting means for a thermal head) 11 are rockably mounted on the top portions of their corresponding fixed frames 2 by means of frame shaft 12 so that the top of platen 1 can be exposed. Shaft 12 is rockably supported, at both ends thereof, on fixed frames 2, and frames 11 are mounted on the opposite end portions of shaft 12 for associated rocking motion. Thus, movable frames 11 are rockable together with frame shaft 12 around the axis thereof, between an open position, where the top portion of the printer between fixed frames 2 is open, as shown in FIG. 1A, and a closed position where the top portion is closed, as shown in FIG. 2. Auxiliary frame 11*a* is pivotally mounted on each movable frame 11, and tension spring 13 is stretched between frame 11*a* and its corresponding fixed frame 2. A slit is bored through each auxiliary frame 11*a*, and guide pin 11*b* protrudes from each fixed frame 2. As pins 11*b* are loosely fitted in the respective slits of their corresponding auxiliary frames 11*a*, movable frames 11 are urged toward the open position by the action of springs 13. When movable frames 11 engage their corresponding stopper shafts 14 on the inside of fixed frames 2, they are retained in the open position.

Head unit 16 is rockably supported on the front end portions of movable frames 11 by means of support shaft 17. Elongated line thermal head 15, which is adapted to be pressed against platen 1, is swingably held on unit 16 with the aid of the means mentioned later. The head unit includes a pair of head arms 18 facing each other and head base 19 fixed to the inside of arms 18. Arms 18 are rockably supported on movable frames 11 by means of support shaft 17.

Head holding portion 20, having a U-shaped cross section and open at the bottom, is formed at the central portion of the front end of head base 19. Holding portion 20 extends along the longitudinal axis of head base 19 (parallel to support shaft 17).

Line thermal head 15 has an elongated configuration extending along the longitudinal axis, and head bracket 23 is fixed to the back of the head. Bracket 23 has engaging recesses 22 individually at its opposite ends, which are adapted to releasably engage platen shaft 21 of platen 1. The engaging portions protrude forward from thermal head 15. U-shaped head coupling portion 24, which is open at the top, is provided on the central portion of bracket 23. Coupling shaft 27, which extends at right angles to the longitudinal axis, is passed through holes 25 and 26 in the center of coupling portion 24 and head holding portion 20, respectively. Thus, line thermal head 15 is mounted on holding portion 20 so as to be swingable around shaft 27 and thus its counter. In other words, head 15 is mounted on head base 19 so that it is swingable around an axis parallel to its front face and perpendicular to the direction of its length. The respective central portions of a pair of leaf springs 28 having a U-shape are coiled around support shaft 17 (FIGS. 2 and 5A to 5C). One end of each spring 28 is held against the rear end of head base 19, thereby urging head unit 16 to rock around shaft 17 toward the platen. Each movable frame 11 has arcuate slot 29 whose center of curvature lies on the axis of support shaft 17. Cam shaft 30 is rockably attached to head unit 16. As both end portions of shaft 30 are fitted in their corresponding slots 29, the rocking motion of head unit 16, i.e., line thermal head 15, relative to movable frames 11, is restricted within a predetermined range.

Figure 4A:
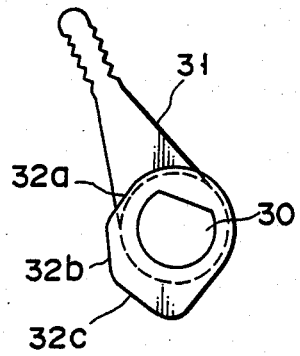
FIGS. 4A and 4B are a side view and a perspective view, respectively, of a head adjusting cam of the printer.
Figure 4B:
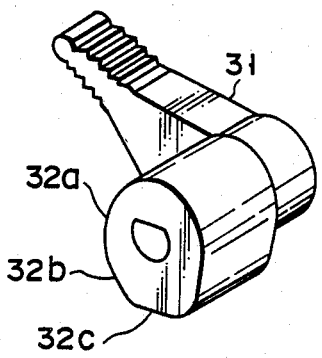
Figure 5A:
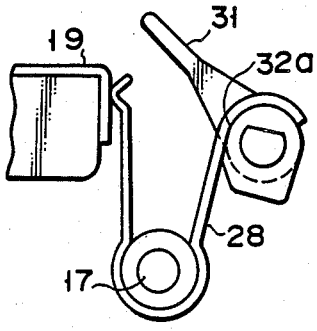
FIGS. 5A, 5B and 5C are side views individually showing different operating states of the adjusting cam.
Figure 5B:
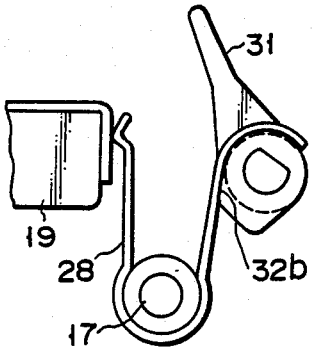
Figure 5C:
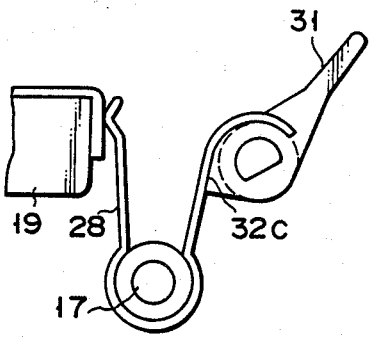
Figure 6:
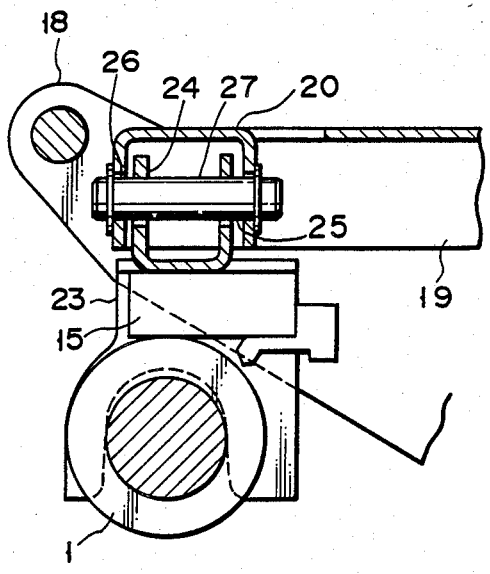
FIG. 6 is a sectional view showing a support structure for a thermal printing head of the printer.

A pair of head adjusting cams 31 are mounted on cam shaft 30. They serve to adjust the urging force of leaf springs 28 by stages. As shown in FIGS. 4A and 4B, a plurality of flat cam faces 32*a*, 32*b* and 32*c* are formed along the outer periphery of cam 31 so that they are situated at different distances from cam shaft 30. A flat face of each leaf spring 28 at the other end portion thereof is urged to be in plane contact with any of flat cam faces 32*a* to 32*c*. In this embodiment, each head adjusting cam has three cam faces. First cam face 32*a* is nearer to shaft 30 than the other two are, and third cam face 32*c* is the remotest. Thus, if spring 28 engages first cam face 32*a*, as shown in FIG. 5A, it applies the smallest urging force to line thermal head 15 to be pressed against the surface of platen. If spring 28 engages second and third cam face 32*b*, 32*c*, as shown in FIGS. 5B, 5C, it applies a greater and the greatest urging forces to head 15, respectively. Since these cam faces are flat surfaces, they serve to lock cam 31 in position as they are engaged by spring 28, unless a lever of the cam is rocked. The selection of the cam face to be engaged depends on the thickness and quality of the paper sheet used. If the sheet is relatively thick or firm, cam 31 is set in the position shown in FIG. 5C to produce the greatest urging force. If the sheet is thin or weak, on the other hand, the cam is set in the position shown in FIG. 5A to reduce the urging force. The urging force of spring 28 to press thermal head 15 toward platen 1 is changed when the position of head bracket 23 relative to platen shaft 21 is slightly shifted.

Paired head adjusting cams 31, which are fixed to cam shaft 30, are adapted to rock together therewith. Therefore, they need not always be two in number, and it is necessary only that at least one adjusting cam be provided for the purpose. Cams 31 are located exposed beside movable frames 11 in order that they can be manually operated from the outside. The respective lower ends of a pair of lock levers 33 are pivotally mounted on the inner surfaces of their corresponding fixed frames 2 by means of shaft 34. Both end portions of shaft 34 are rockably supported on their corresponding fixed frames 2. Thus, lock levers 33 are mounted on frames 2 so as to be rockable around the axis (indicated by line B—B in FIG. 3) of shaft 34. When movable frames 11 are brought to the closed position, levers 33 engage the top of support shaft 17 so that shaft 17 is fitted and retained in recesses 35 formed in the respective top edges of fixed frames 2, thereby preventing movable frames 11 from rocking. Each lever 33 is urged in the counterclockwise direction of FIG. 1A by means of tension spring 36. Knob 37 is attached to one of lock levers 33. If knob 37 is operated to rock levers 33 in the clockwise direction of FIG. 1A, against the urging force of springs 36, movable frames 11 are released from the locked state. In rocking frames 11 to the closed position, support shaft 17 is held against the lateral faces of lock levers 33, and levers 33 are rocked against the urging force of springs 36. When movable frames 11 are rocked in this manner, they are locked automatically.

Sheet holding member 38 for holding wide label sheet P protrudes from the rear end portions of fixed frames 2. It is composed of a pair of support arms spaced in the longitudinal direction of the printer. A bearing or recess is formed on the top surface of each support arm. Rolled label sheet P is wound around a support shaft, both end portions of which project individually from the opposite sides of sheet P. As the projecting end portions of the shaft are rotatably supported by the bearings of the support shafts, sheet P is held by holding portion 38 so as to be rotatable around the axis of the support shaft. The leading end of sheet P is drawn out from its outermost periphery. Thus, sheet P is guided to a printing section through sheet guide passage 39, which is composed of a pair of curved plates vertically spaced at a very short distance from each other and arranged below movable frames 11. Paper sensor 40 is attached to that portion of passage 39 situated between platen 1 and sheet rewinding roller 10. Sensor 40 serves to optically detect the presence of label sheet P, that is, the leading end of the sheet.

Ink ribbon supply roll 41 and ink ribbon take-up roll 42 are rotatably mounted on the inside of fixed frames 2. Supply roll 41 serves to feed wide ink ribbon R to the printing section, while take-up roll 42 is used to wind the used portion of the ink ribbon. Rolls 41 and 42 are removably held by their corresponding pairs of roll holders 43 and 44, which are mounted individually on the inside of frames 2. Ink ribbon R on supply roll 41 is wound around take-up roll 42 after being passed around a plurality of ribbon guide shafts 45 (three in this embodiment), which are fixed to head arms 18 and extend parallel to the longitudinal axis of the printer. One of paired roll holders 43 is pressed against one end face of roll 41 by means of a coil spring disposed between itself and its corresponding fixed frame 2. Likewise, one of roll holders 44 is pressed against one end face of roll 42 by means of another coil spring disposed in the same manner. Thus, rolls 41 and 42 can be easily mounted on or removed from their corresponding holders 43 and 44. The other of holders 44 for take-up roll 42 is coaxially connected to take-up gear 47 by means of one-way clutch 48. As shown in FIG. 1A, take-up gear 47 is operatively connected, by means of a gear train, to take-up motor 46 which is fixed to the inside of one of fixed frames 2. Thus, as the driving force of motor 46 is transmitted to ink ribbon take-up roll 42 via take-gear 47 and one-way clutch 48, roll 42 is rotated in a take-up direction or the clockwise direction of FIG. 2. Feed gear 49, which contains one-way clutch 49*a* therein, is coaxially attached to the other of roll holders 43 which hold ink ribbon supply roll 41. Gear 49 is in mesh with a large-diameter portion of intermediate gear 50, a double gear. A small-diameter portion of gear 50 is in mesh with ribbon rewinding gear 51 which is coaxially fixed to frame shaft 12 between movable frames 11. Gear 51 is composed of a sector gear whose center is on the axis of shaft 12. Thus, when movable frames 11 are rocked to the closed position, rewinding gear 51 also rocks, thereby causing intermediate gear 50 to rotate through an angle corresponding to the rocking motion of frames 11. The rotation of gear 50 is transmitted through feed gear 49 to the other roller holder 43. Thereupon, supply roll 41 is rotated through a predetermined angle in the clockwise direction of FIG. 2, i.e., in the direction opposite to a ribbon feeding direction.

Figure 3:
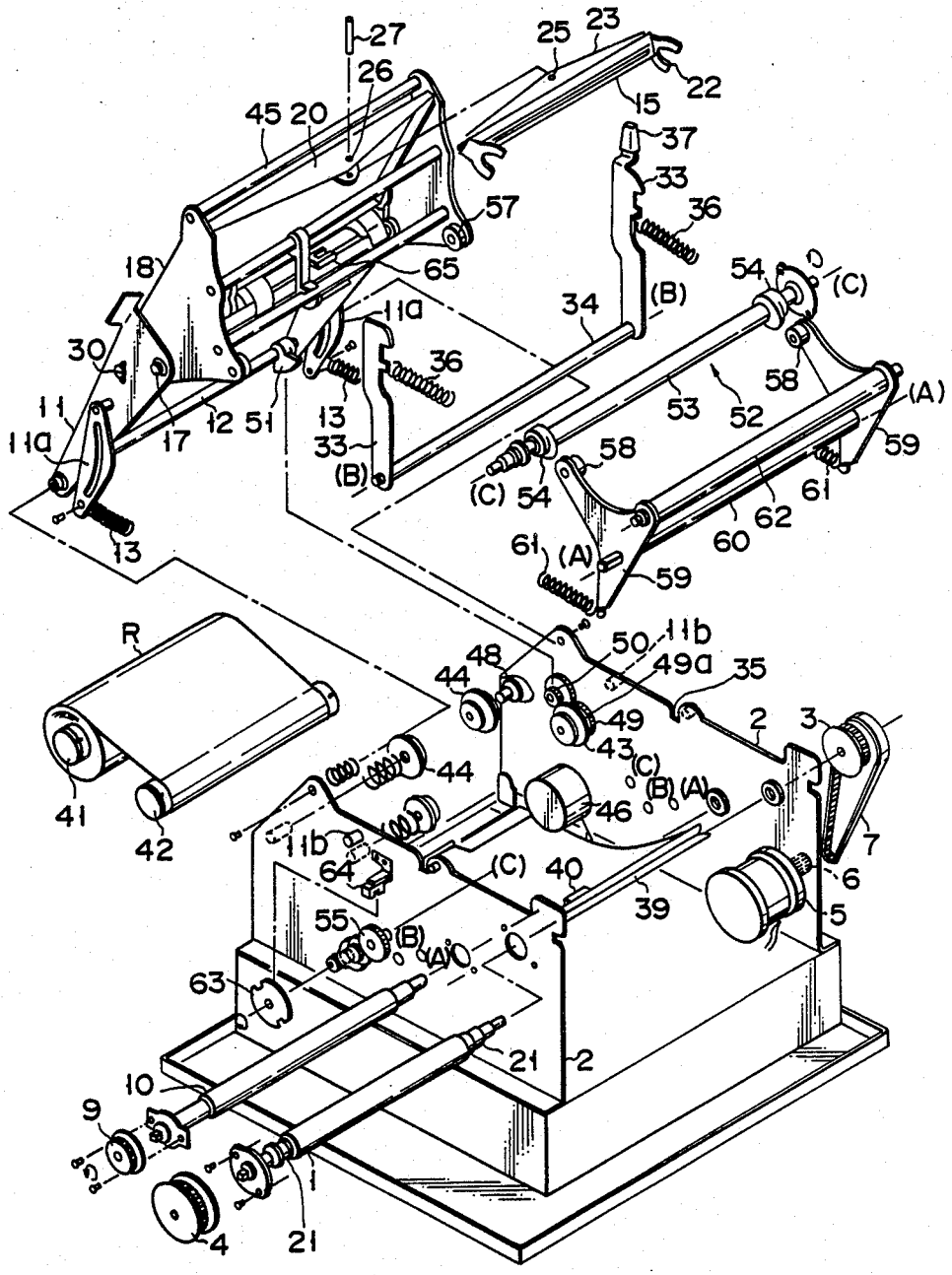
FIG. 3 is an exploded perspective view of the printer.
Figure 7:
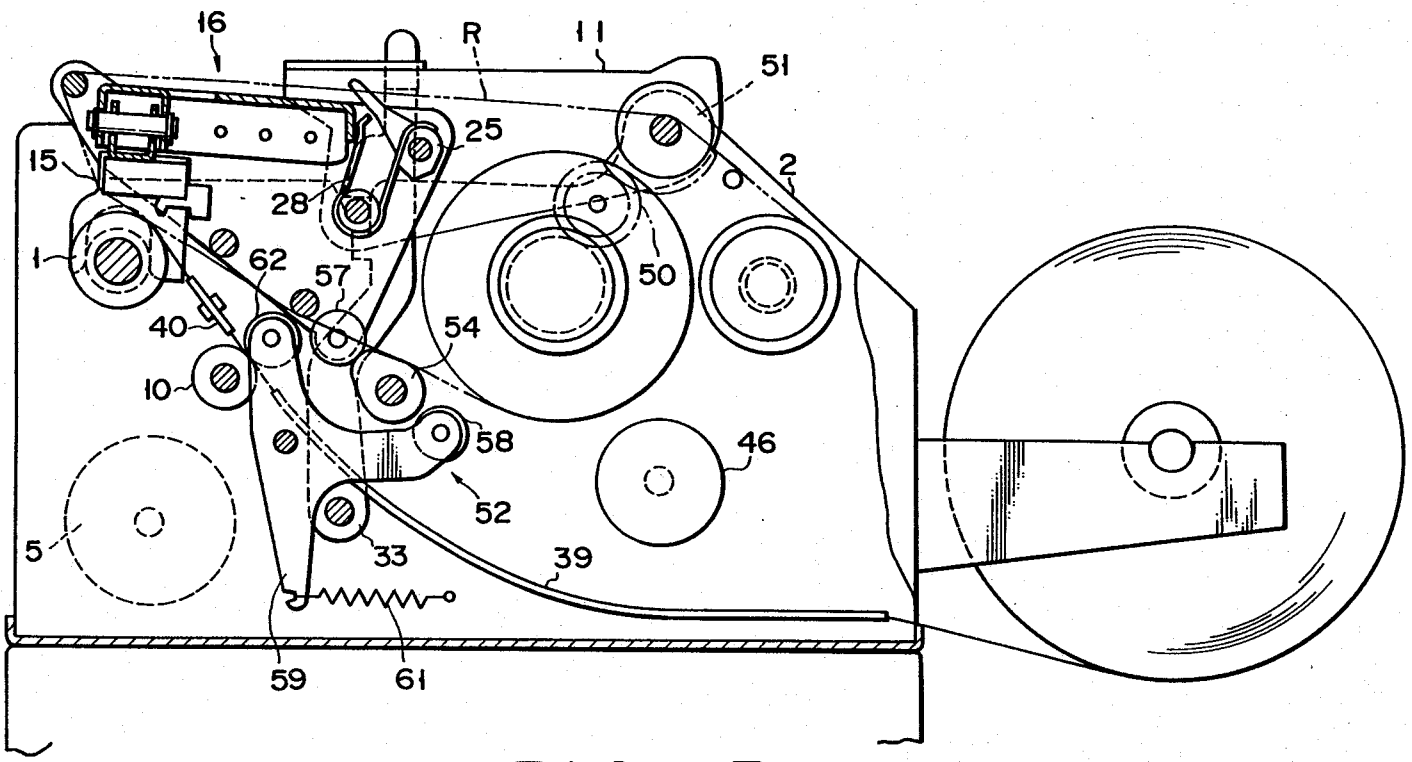
FIG. 7 is a sectional view, similar to FIG. 2, illustrating the operation of a head-up mechanism of the printer.

Head-up mechanism 52 is located beside sheet rewinding roller 10. It serves to temporarily force up line thermal head 15, in pressure contact with platen 1, when movable frames 11 are in the closed position. As shown in FIG. 3, mechanism 52 includes cam shaft 53 and a pair of cams 54 fixed individually to the opposite end portions of shaft 53. Shaft 53, which extends in the longitudinal direction (line C—C) of the printer, is rotatably supported, at both ends thereof, to fixed frames 2. Gear 55 (FIG. 1B) is coaxially mounted on one end of cam shaft 53. It is connected, by means of a gear train, to cam drive motor 56 which attached to the other fixed frame 2. Thus, cam 54 is rotated by means of motor 56. A pair of head-up rollers 57 are rotatably mounted on head arms 18, individually, so that they are situated in the paths of rotation of their corresponding cams 54 when movable frames 11 are in the closed position. A pair of sheet rewinding arms 59 are arranged inside those portions of fixed frames 2 near sheet rewinding roller 10. Each end portion of shaft 60, which extends parallel to roller 10, is fixed to the central portion of each corresponding arm 59. Both ends of shaft 60 are movably supported on fixed frames 2, individually. As shaft 60 rocks, arms 50 can rock together therewith around the longitudinal axis (line A—A) of shaft 60. Pinch roller 62, which extends parallel to rewinding roller 10, is rotatably supported, at both ends thereof, on sheet rewinding arms 59. Tension spring 61 is disposed between each arm 59 and its corresponding fixed frame 2. As shown in FIG. 7, spring 61 urges arm 50 to rock in the counterclockwise direction, thereby pressing pinch roller 62 against sheet rewinding roller 10. Release rollers 54, which can engage cams 54, are rotatably mounted on sheet rewinding arms 59, individually. When cams 54 engage their corresponding rollers 58, arms 59 are rocked against the urging force of springs 61, so that pinch roller 62 is disengaged from rewinding roller 10. In FIG. 3, numeral 63 designates a cam detecting plate attached to one end of cam shaft 53. Numeral 64 designates a cam sensor for optically detecting the rotational position of cams 54 through detecting plate 63, while numeral 65 denotes a ribbon sensor for optically detecting the presence of ink ribbon R.

In printing on wide label sheet P, in the printer with the arrangement described above, ink ribbon supply roll 41 and ink ribbon take-up roll 42 are first set inside fixed frames 2. The leading end of ink ribbon R, wound around supply roll 41, is passed around ribbon guide shafts 45 between head arms 18, and is then anchored to take-up roll 42. Meanwhile, the leading end portion of label sheet P, held by sheet holding portion 38, is drawn out and passed through sheet guide passage 39 to be set on platen 1. Then, in this state, movable frames 11 are brought down to the closed position, where they are fixed to fixed frames 2, and line thermal head 15 is pressed against platen 1. As movable frames 11 rock in this manner, ribbon rewinding gear 51 also rock, thereby causing ribbon supply roll 41 to rotate in the counterclockwise direction of FIG. 2, through the medium of intermediate gear 50 and feed gear 49. Thereupon, ink ribbon R, which is drawn out long to cover ribbon take-up roll 42 via supply roll 41 and thermal head 15, is rewound. Accordingly, a tension toward supply roll 41 is applied to ribbon R, so that the ribbon can be prevented from slackening or be smoothed out. Ribbon rewinding gear 51 rocks also when movable frames 11 are raised from fixed frames 2. In this case, however, ribbon supply roll 41 never rotates, since one-way clutch 49a is contained in feed gear 49.

When line thermal head 15 is pressed against platen 1, moreover, cam drive motor 56 is caused to rotate for a predetermined amount by means of a detection switch (not shown). Thereupon, cams 54, having so far been in engagement with release rollers 58, are caused to engage head-up rollers 57. Thus, pinch roller 62 is pressed against sheet rewinding roller 10, and thermal head 15 is forced up through the medium of head arms 18, as shown in FIG. 7.

When line thermal head 15 is lifted from platen 1, platen drive motor 5 rotates reversely. Thus, label sheet P, held between pinch roller 62 and sheet rewinding roller 10, is retreated from platen 1 as roller 10 rotates. When paper sensor 40 detects passage of the leading end of sheet P, the rotation of motor 5 is stopped in response to an output signal from the sensor. Thereupon, the leading end of the sheet is set in a predetermined position behind sensor 40, whereupon its alignment is completed. In this state, platen drive motor 5 rotates forward, and cam drive motor 56 rotates again for a predetermined amount in response to the output signal from sensor 40, after the passage of a predetermined time (or when sheet P is brought onto platen 1). As a result, cams 54, having so far been in engagement with head-up rollers 57, are caused to engage release rollers 58. Thus, thermal head 15 is pressed again against platen 1 with the leading end portion of sheet P between the two, and pinch roller 62 is separated from sheet rewinding roller 10, as shown in FIG. 2. Thereafter, thermal head 15 is heated to accomplish a specific cycle of printing operation, and platen 1 is rotated to feed label sheet P forward.

Figure 8:
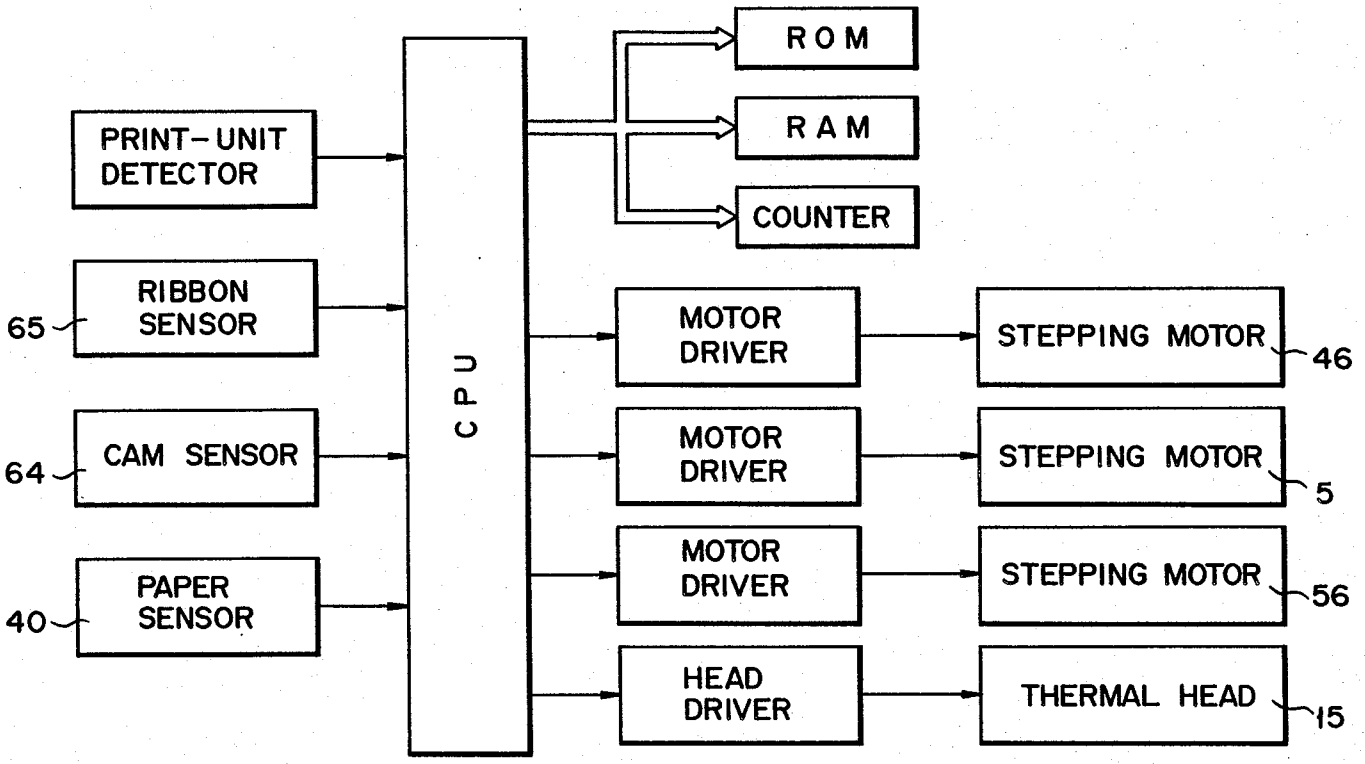
FIG. 8 is a block diagram of an electrical control system of the printer.

FIG. 8 shows an electrical control system of the thermal transfer printer with the aforementioned construction. As seen from FIG. 8, a CPU is used as a principal control means for the printing operation. In this system, a ROM and a RAM are designed for label layout, just as in the case of the prior art printers.

In the embodiment described above, the thermal transfer printer uses the ink ribbon for printing. However, the ink ribbon need not always be used, and the printer may be of a type such that the thermal head can print directly on a heat-sensitive paper sheet.

What is claimed is:

1. A thermal printer comprising:
a platen (1);
platen supporting means (2) for supporting the platen;
a thermal head (15) having an intermediate portion;
thermal head supporting means (11, 16, 27) movable relative to the platen supporting means for swingably supporting the thermal head for swinging movement around its intermediate portion, said thermal head supporting means being movable so as to press the thermal head against the platen; and
resilient urging means (28, 31) for resiliently urging the thermal head supporting means toward the platen supporting means for resiliently pressing the thermal head against the platen.

2. The thermal printer according to claim 1, wherein:
said thermal head supporting means includes a movable frame (11) having a first axis and pivotally mounted on the platen supporting means so as to be pivotable around the first axis, and a head unit (16) having a second axis and pivotally mounted on the movable frame so as to be pivotable around the second axis, said head unit pivotally supporting the thermal head; and
said resilient urging means is disposed between the movable frame and the head unit for urging the head unit to pivot in one direction with respect to the movable frame.

3. The thermal printer according to claim 2, wherein:
said thermal head extends along the second axis;
said resilient urging means includes a pair of spring members (28) spaced at a predetermined distance from each other along the second axis; and
said thermal head is pivotally mounted on the head unit so as to be situated between said pair of spring members.

4. The thermal printer according to claim 3, wherein said head unit includes a support member (27) for pivotally supporting the thermal head so that the thermal head is pivotable around an axis perpendicular to the first axis.

5. The thermal printer according to claim 3, wherein said spring member includes a portion fixed to the movable frame and a free end portion for resiliently urging the head unit.

6. The thermal printer according to claim 5, wherein said movable frame and said head unit are connected to each other so that the first and second axes extend substantially parallel to each other.

7. The thermal printer according to claim 6, further comprising means (29, 30) for restricting the pivoting motion of the head unit, with respect to the movable frame, within a predetermined angular range.

8. The thermal printer according to claim 1, further comprising supply means (38, 39, 41, 42) for supplying an ink ribbon (R) and a paper sheet (P) to a region between the platen and the thermal head, said supply means being individually mounted on the supporting means.

9. The thermal printer according to claim 1, wherein said thermal head supporting means includes a pin-like means (27) for swingably supporting the thermal head for swinging movement around the intermediate portion thereof.

10. A thermal printer comprising:
a platen (1);
platen supporting means (2) for supporting the platen;
a thermal head (15) having an intermediate portion;
thermal head supporting means (11, 16, 27) movable relative to the platen supporting means for supporting the thermal head for swinging movement around its intermediate portion, said thermal head supporting means being movable for pressing the thermal head against the platen;
supply means (38) for supplying a paper sheet (P) between the platen and the thermal head;
resilient urging means (28) for resiliently urging the thermal head supporting means toward the platen supporting means for resiliently pressing the thermal head against the platen across the paper sheet; and
head pressure adjusting means (30, 31, 32*a*, 32*b*, 32*c*) coupled to said resilient urging means for changing the urging force of said resilient urging means by stages in accordance with a quality of the paper sheet.

11. The thermal printer according to claim 10, wherein said resilient urging means includes at least one leaf spring (28) attached to said platen supporting means.

12. The thermal printer according to claim 11, wherein said head pressure adjusting means includes cam member pivotally supported on the thermal head supporting means and being engageable by said at least one leaf spring, whereby the urging force of said at least one leaf spring is changed as the cam member pivots.

13. The thermal printer according to claim 12, wherein said cam member has a central axis serving as the center of pivoting motion thereof, a plurality of cam faces (32*a*, 32*b*, 32*c*) situated at different distances from the central axis, and an operating lever means for rotating the cam faces around the central axis.

14. The thermal printer according to claim 13, wherein:
said thermal head supporting means includes a movable frame (11) pivotably supported on the platen supporting means and a head unit (16) pivotably supported on the movable frame and supporting the thermal head for swinging motion; and
said at least one leaf spring has one end engaging the head unit, another end which is engageable with one of the cam faces of the cam member, and an intermediate portion supported by the movable frame, whereby the cam member is locked in position as said another end of said at least one leaf spring is in plane contact with a specified cam face.

15. The thermal printer according to claim 14, further comprising means (41, 42) for supplying an ink ribbon (R) to a region between the thermal head and the platen.

16. The thermal printer according to claim 10, wherein said head pressure adjusting means includes a cam member pivotably supported on the thermal head supporting means and being engageable by said resilient urging means, whereby the urging force of said resilient urging means is changed as the cam member pivots.

17. The thermal printer according to claim 16, wherein said cam member has a central axis serving as the center of pivoting thereof, a plurality of cam faces (32*a*, 32*b*, 32*c*) situated at different distances from the central axis, and an operating lever means for rotating the cam faces around the central axis.

18. The thermal printer according to claim 17, wherein:
said thermal head supporting means includes a movable frame (11) pivotably supported on the platen supporting means and a head unit (16) pivotably supported on the movable frame and supporting the thermal head for swinging motion; and said resilient urging means has one end portion engaging the head unit, another end portion which is engageable with one of the cam faces of the cam member, and an intermediate portion supported by the movable frame, whereby the cam member is locked in position as said another end portion of said resilient urging means is in plane contact with a specified cam face.

19. The thermal printer according to claim 18, further comprising means (41, 42) for supplying an ink ribbon (R) to a region between the thermal head and the platen.

20. The thermal printer according to claim 10, further comprising means (41, 42) for supplying an ink ribbon (R) to a region between the thermal head and the platen.

21. A thermal printer comprising:

a platen (1);

platen supporting means (2) for supporting the platen;

a thermal head (15) having an intermediate portion;

thermal head supporting means (11, 16, 27) movable relative to the platen supporting means for swingably supporting the thermal head for swinging movement around its intermediate portion, said thermal head supporting means being movable so as to press the thermal head against the platen: and said resilient urging means (28, 31) for resiliently urging the thermal head supporting means toward the platen supporting means for resiliently pressing the thermal head against the platen;

said resilient urging means includes a pair of spring members (28) spaced at a predetermined distance from each other and said thermal head being pivotally mounted on the thermal head supporting means so as to be situated between said pair of spring members.

22. The thermal printer according to claim 21, wherein:

said thermal head supporting means includes a movable frame (11) having a first axis and pivotally mounted on the platen supporting means so as to be pivotable around the first axis, and a head unit (16) having a second axis and pivotally mounted on the movable frame so as to be pivotable around the second axis, said head unit pivotally supporting the thermal head; and said resilient urging means is disposed between the movable frame and the head unit for urging the head unit to pivot in one direction with respect to the movable frame.

23. The thermal printer according to claim 22, wherein:

said thermal head extends along the second axis;

said resilient urging means includes a pair of spring members (28) spaced at a predetermined distance from each other, and said thermal head being pivotally mounted on the thermal head supporting means so as to be situated between said pair of spring members.

24. The thermal printer according to claim 23, wherein said head unit includes a support member (27) for pivotally supporting the thermal head so that the thermal head is pivotable around an axis perpendicular to the first axis.

25. The thermal printer according to claim 23, wherein said spring member includes a portion fixed to the movable frame and a free end portion for resiliently urging the head unit.

26. The thermal printer according to claim 25, wherein said movable frame and said head unit are connected to each other so that the first and second axes extend substantially parallel to each other.

27. The thermal printer according to claim 26, further comprising means (29, 30) for restricting the pivoting motion of the head unit, with respect to the movable frame, within a predetermined angular range.

28. The thermal printer according to claim 21, further comprising supply means (38, 39, 41, 42) for supplying an ink ribbon (R) and a paper sheet (P) to a region between the platen and the thermal head, said supply means being individually mounted on the supporting means.

29. The thermal printer according to claim 21, wherein said thermal head supporting means includes a pin-like means (27) for swingably supporting the thermal head for swinging movement around the intermediate portion thereof.

30. A thermal printer comprising:

a platen (1);

platen supporting means (2) for supporting the platen;

a thermal head (15) having an intermediate portion;

thermal head supporting means (11, 16, 27) movable relative to the platen supporting means for supporting the thermal head, said thermal head supporting means being movable for pressing the thermal head against the platen;

supply means (38) for supplying a paper sheet (P) between the platen and the thermal head;

resilient urging means (28) for resiliently urging the thermal head supporting means toward the platen supporting means for resiliently pressing the thermal head against the platen across the paper sheet; and head pressure adjusting means (**30, 31, 32*a*, 32*b*, 32*c*) coupled to said resilient urging means for changing the urging force of said resilient urging means by stages in accordance with a quality of the paper sheet; p1 said resilient urging means including leaf spring means comprising a pair of leaf springs (28**) attached to said platen supporting means so as to be spaced at a predetermined distance from each other.

31. The thermal printer according to claim 30, wherein said head pressure adjusting means includes a cam member pivotably supported on the thermal head supporting means and being engageable by said at least one of the leaf springs, whereby the urging force of the leaf springs is changed as the cam member pivots.

32. The thermal printer according to claim 31, wherein said cam member has a central axis serving as the center of pivoting motion thereof, a plurality of cam faces (**32*a*, 32*b*, 32*c***) situated at different distances from the central axis, and an operating lever means for rotating the cam faces around the central axis.

33. The thermal printer according to claim 32, wherein:

said thermal head supporting means includes a movable frame (11) pivotally supported on the platen supporting means and a head unit (16) pivotably supported on the movable frame and supporting the thermal head for swinging motion; and said leaf spring means has one end engaging the head unit, another end which is engageable with one of the cam faces of the cam member, and an intermediate portion supported by the movable frame, whereby the cam member is locked in position as said another end of said leaf spring means is in plane contact with a specified cam face.

34. The thermal printer according to claim 33, further comprising means (41, 42) for supplying an ink ribbon (R) to a region between the thermal head and the platen.

35. The thermal printer according to claim 30, further comprising means (41, 42) for supplying an ink ribbon (R) to a region between the thermal head and the platen.

* * * * *